US011702889B2

(12) United States Patent
Percy et al.

(10) Patent No.: US 11,702,889 B2
(45) Date of Patent: Jul. 18, 2023

(54) MARITIME DRILLING WITH FLUID REVERSE CIRCULATION WITHOUT USING DRILLING RISER

(71) Applicant: PETROLEO BRASILEIRO S.A.—PETROBRAS, Rio de Janeiro (BR)

(72) Inventors: Joseir Gandra Percy, Nova Iguaçú (BR); Roni Abensur Gandelman, Rio de Janeiro (BR); Guilherme Ribeiro Magalhaes, Macaé (BR); Emilio Cesar Cavalcante Melo Da Silva, Rio de Janeiro (BR); Guilherme Siqueira Vanni, Niterói (BR); Augusto Borella Hougaz, Rio de Janeiro (BR); Joao Carlos Ribeiro Placido, Rio de Janeiro (BR); Hugo Francisco Lisboa Santos, Rio de Janeiro (BR)

(73) Assignee: PETROLEO BRASILEIRO S.A.—PETROBRAS, Rio de Janeiro (BR)

( * ) Notice: Subject to any disclaimer, the term of this patent is extended or adjusted under 35 U.S.C. 154(b) by 0 days.

(21) Appl. No.: 17/698,724

(22) Filed: Mar. 18, 2022

(65) Prior Publication Data

US 2022/0307322 A1 Sep. 29, 2022

(30) Foreign Application Priority Data

Mar. 22, 2021 (BR) ..... 10 2021 005383 6

(51) Int. Cl.

| | |
|---|---|
| ***E21B 7/128*** | (2006.01) |
| ***E21B 21/08*** | (2006.01) |
| ***E21B 21/10*** | (2006.01) |

(52) U.S. Cl.
CPC ..... *E21B 7/128* (2013.01); *E21B 21/08* (2013.01); *E21B 21/10* (2013.01)

(58) Field of Classification Search
CPC ..... E21B 7/128; E21B 21/08; E21B 21/10
See application file for complete search history.

(56) References Cited

U.S. PATENT DOCUMENTS 4,149,603 A * 4/1979 Arnold ..... E21B 7/128 166/368
7,134,512 B2 * 11/2006 Head ..... E21B 4/02 175/45

(Continued)

*Primary Examiner* — Matthew R Buck
(74) *Attorney, Agent, or Firm* — Sughrue Mion, PLLC

(57) ABSTRACT

The present invention refers to a method of drilling a marine wellbore with fluid reverse circulation without using drilling riser tubulars. In reverse circulation drilling, the fluid return with gravels occurs inside the drill string (17) and the injection of clean fluid is done through the annular of the well, so that, having a rotating head over the BOP (19), or inside it, the use of riser tubulars as a flow line for the fluid return with gravels is disposed, using instead the drill string (17).

For the kill and choke lines, as well as for fluid injection, rigid or flexible lines can be used, eliminating the need to use drilling risers, thus releasing large load capacity and space on the probe. The method of this invention also eliminates the need for large volumes of fluid to fill entire riser tubulars. The entire operation can be done without the need for subsea pumps or concentric columns. Additionally, the invention makes the operation of lowering the drilling riser tubulars unnecessary, which lasts for days and has a high cost. Finally, for dual activity probes, the arrangement allows the use of the two towers even after connecting the BOP (19), something that is not possible with the use of drilling riser tubulars. Therefore, operations such as mounting and low- (Continued)

ering the casing in the water depth can be carried out in parallel with the drilling of the phase, allowing a significant additional gain of time.

10 Claims, 5 Drawing Sheets

(56) References Cited

U.S. PATENT DOCUMENTS

| | | | | |
|---|---|---|---|---|
| 7,913,764 | B2 * | 3/2011 | Smith | E21B 21/10 166/345 |
| 7,938,190 | B2 * | 5/2011 | Talamo | E21B 21/015 175/7 |
| 7,958,948 | B2 * | 6/2011 | Stave | E21B 21/08 166/347 |
| 7,984,765 | B2 * | 7/2011 | Askeland | E21B 33/076 166/347 |
| 8,342,249 | B2 * | 1/2013 | Payne | E21B 7/12 166/368 |
| 9,010,431 | B2 * | 4/2015 | Billington | E21B 19/002 166/368 |
| 9,062,498 | B2 * | 6/2015 | Potter | E21B 33/064 |
| 9,145,761 | B2 * | 9/2015 | Hallundbæk | E21B 33/076 |
| 9,702,210 | B2 * | 7/2017 | Dirksen | E21B 33/038 |
| 9,903,172 | B2 * | 2/2018 | Hansen | E21B 33/035 |
| 11,008,811 | B2 * | 5/2021 | Wijning | E21B 7/124 |
| 2017/0175466 | A1 * | 6/2017 | Dirksen | E21B 33/035 |

* cited by examiner

MARITIME DRILLING WITH FLUID REVERSE CIRCULATION WITHOUT USING DRILLING RISER

FIELD OF THE INVENTION

The present invention refers to a method of drilling a maritime wellbore with fluid reverse circulation without using tubulars connecting probes to the well, called a drilling riser, which can be applied in maritime wellbores that are built with the use of single or dual activity probes, such as deepwater or ultra-deepwater offshore wells, with the primary function of increasing operational efficiency and reducing the cost of drilling a wellbore.

DESCRIPTION OF THE STATE OF THE ART

In drilling of oil wellbore in deepwater there are several challenges, one of which is the need to use a large amount of drilling riser joints. Each joint has high weight (about 32,000 lb or 15 ton) and large dimensions (about 23 m long and diameter of 21 in). Another challenge is the demand for a greater capacity of the fluid circulation system's tanks. Just to fill the riser tubulars, a volume of the order of 470,000 liters (3000 bbl) is required for a water depth of 2,500 m. A third challenge is the need to use pumps with a higher flow rate to allow the transport of gravel inside the riser.

In addition to the technical challenges, there are also economic issues, since offshore probes have a high daily operating cost. The probes currently correspond to around 50% of the wellbore construction cost and are paid per day worked. In addition, other services performed are also paid per day available or per day worked. The lowering of the riser tubulars, in particular, is an activity that requires a lot of hours. In maritime wellbores with water depths greater than 1,500 m, several days are spent in the well construction stage, due to the long way to be traveled in the maneuvers due to the stretch of sea.

The traditional solution for drilling in deeper water depths has been the adoption of riser tubulars with thicker wall and probes with more pumps and greater load capacity. However, there is an alternative solution under study for almost two decades, which is to perform operations without riser tubulars. In the typical suggested configurations, subsea pumps are adopted for the return of the fluid with gravels (US20160047187A1), or concentric columns are used (US20170058632A1). However, the use of subsea pumps introduces a low reliability component into the system. In addition, it adds complexity to the set, as it changes the riser tubulars, which are components without movable parts and with a low failure rate, by subsea pumps, with movable parts and a high failure rate.

On the other hand, to increase operational efficiency and reduce costs, it is attempted to reduce the total time of well construction. One way to do this is to perform as many operations as possible—in parallel. For example, load transfer and movement operations are almost all carded out in parallel. Likewise, the equipments that will go down the wellbore are prepared hours or even days in advance.

Thus, some systems were proposed that allow that other operations leave the critical path and be performed in parallel. One such proposal is the use of dual activity probes (patent EP1277913B1). These probes allow the performance of some operations simultaneously, in each of the towers, removing the fastest operation from the critical path. However, its advantage is limited to situations where the BOP (Blowout Preventer) and the riser pipe are not positioned at the wellhead. When the BOP and the riser pipe are connected, all operations are necessarily performed through a single path.

The drilling technique with fluid reverse circulation was implemented from 2006, to improve cleaning efficiency of gravel in critical hydraulic scenarios in the onshore wells, being described in patent PI0605527-3B1.

Document PI0605527-3B1 method for drilling wellbores with fluid reverse circulation used to remove gravels resulting from this operation. The method consists of using an annular isolation rotating device that allows pumping the fluid to remove the gravels through the annular space formed between the drill string and the well wall. This fluid reaches the bottom hole, penetrates the drill string, through the drill holes, and carries the gravels to the surface of the drill string. The fluid is diverted, at the top of the drill string, to a gravel separation unit, where the gravels are separated from the fluid. The fluid is conveyed to the storage tank, where it is aspirated by a pumping unit and then pumped back into the annular space of the well. For the application of the method, it is necessary that the annular space is isolated from the atmosphere by an annular isolation rotating device. Unlike the present invention, the description refers to drilling with reverse circulation in onshore wells, where drilling risers is no longer used. In the present invention, the proposal is a reverse circulation drilling in offshore wells without this equipment.

The method of the present invention refers to a process of drilling a marine wellbore with fluid reverse circulation without using drilling riser tubulars. In this case, the return of the fluid with gravels occurs through the interior of the drill string and the injection of clean fluid is made through the annular of the well. In the operation, the use of the riser tubulars as a flow line for the fluid return with gravels is disposed, using instead the drill string itself. As a result, the operation of lowering the drilling riser tubulars, which lasts for days and has a high cost, becomes unnecessary.

For dual activity probes, the arrangement of this invention allows the use of the two towers even after connecting the BOP, something that is not possible with the use of the drilling riser tubular connected to the BOP. Thus, operations such as mounting and lowering the casing can be performed in parallel with the drilling operation of the previous phase, allowing a significant additional gain of time.

The document WO2013077905A2 provides an equipment packages and control methods using two or more lifting systems that operate simultaneously and continuously in a synchronized manner such that the feeding of tubular into or out of a well is achieved with continuous or near continuous movement, without the need for periodic interruptions. The drilling and tripping equipment packages and control schemes are also able to rotate the tubular in the wellbore with continuous speed and torque sufficient for both drilling and back-reaming operations. The drilling and tripping equipment package and control scheme is additionally able to circulate drilling fluid into the internal bore of the tubular with sufficient pressure and flow to facilitate both drilling and back-reaming operations, with minimal interruption to circulation.

Also, the document WO2013077905A2, despite dealing with a method to simplify oil well drilling processes, seeking to reduce the time lost mainly during the process of removing the drill string, does not reveal how the operations, such as mounting and casing lowering can be performed in parallel with the drilling of the previous phase, allowing a significant additional gain of time, such as the method of the present invention. In particular, the patent deals with a continuous circulation system. It has no connection with the proposal to withdraw the drilling riser, such as this invention.

Document KR101707496B1 refers to a method of assembling/disassembling various pipes for drilling simultaneously with a drilling operation, a blow-out preventer (BOP), and installing/disassembling a Christmas tree so as to shorten the drilling time, which is a conventional problem. The auxiliary structure for the drilling operation is installed on the deck of the drilling rig to perform the auxiliary operation for the drilling operation simultaneously or independently with the drilling operation by the derrick. Although the document offers a drilling method with the objective of reducing drilling time, it uses drilling risers, unlike this invention. The subject patent refers to the use of probes with an auxiliary table. The withdrawal of the riser and the use of reverse circulation does not directly require the probe with auxiliary table, nor the probe with two tables. Using a two-table probe when drilling without riser, as exemplified in U.S. Pat. No. 6,085,851A, leverages the advantages of operation, which does not occur with the auxiliary table probe.

Document EP1277913B1 refers to a multi-activity device on a drilling probe, having two towers and multiple tubular activity stations inside the tower, in which the primary drilling activity can be conducted from one of the towers and, simultaneously, another drilling activity (auxiliary) can be conducted from the other tower, to reduce the critical path length of the well construction activity. According to the document, it is possible to perform some operations simultaneously; however, its advantage is limited to situations where the BOP and the riser are not positioned at the wellhead. When the BOP and the riser are connected, all operations must be performed, mandatorily, by the tower where the BOP is positioned, which is different from the present invention in which the arrangement allows the use of more than one tower even after the BOP is connected.

As will be further detailed below, the present invention refers to a process of drilling a marine wellbore with fluid reverse circulation without using drilling riser tubulars, with different characteristics and that provide advantages in relation to what is revealed by the documents of the State of the Art.

BRIEF DESCRIPTION OF THE INVENTION

The present invention refers to a method of drilling a marine wellbore with fluid reverse circulation without using drilling riser tubulars. In reverse circulation drilling, the return of the fluid with gravels occurs through the interior of the drill string and the injection of clean fluid is made through the annular of the wellbore. Thus, having a rotating head on or inside the BOP, the use of the drilling riser tubular as a flow line for the return of the fluid with gravels is disposed, using instead the drill string itself. For the kill and choke lines, as well as for fluid injection, rigid or flexible lines can be used.

This eliminates the need to use drilling riser tubulars, thus releasing the load capacity in the probe, in addition to the space occupied by this equipments. It also eliminates the need for large volumes of fluid to fill riser tubulars.

Unlike proposals present in the State of the Art, the entire operation can be done without the need for subsea pumps, equipments of high complexity and low reliability, and without the need for concentric columns, unconventional equipments, complex, of difficult handling on the probe and with inferior drilling performance.

Additionally, the method of this invention makes the operation of lowering the drilling riser tubulars unnecessary, which lasts for days and has a high cost. This allows for savings of millions of dollars in the construction of the wellbore.

Finally, for dual activity probes, the arrangement allows the use of the two towers even after connecting the BOP, something that is not currently possible with the connection of the drilling riser tubulars to the BOP. Therefore, operations such as mounting and lowering the casing can be performed in parallel with the drilling operation of the previous phase, allowing a significant time gain.

Objects

Some of the objects to be achieved by the subject of the present invention are:

- Increasing operational efficiency by reducing the time and cost of drilling wells;
- Providing greater system reliability compared to the use of subsea pump;
- Releasing load capacity on the probe and space occupied by the drilling risers;
- For dual activity probes, allowing the use of two towers even after connecting the BOP;
- Reducing the risk exposure time of teams involved in riser moving operations.

BRIEF DESCRIPTION OF DRAWINGS

The present invention will be described in more detail below, with reference to the attached figures which, in a schematic form and not limiting the inventive scope, represent examples thereof. In the drawings, there are.

DETAILED DESCRIPTION OF THE INVENTION

Preliminarily, it is noted that the following description will start with the preferred embodiments of the invention. As will be apparent to any person skilled in the art, however, the invention is not limited to these particular embodiments, but rather to the scope defined in the claims.

Figure 1:
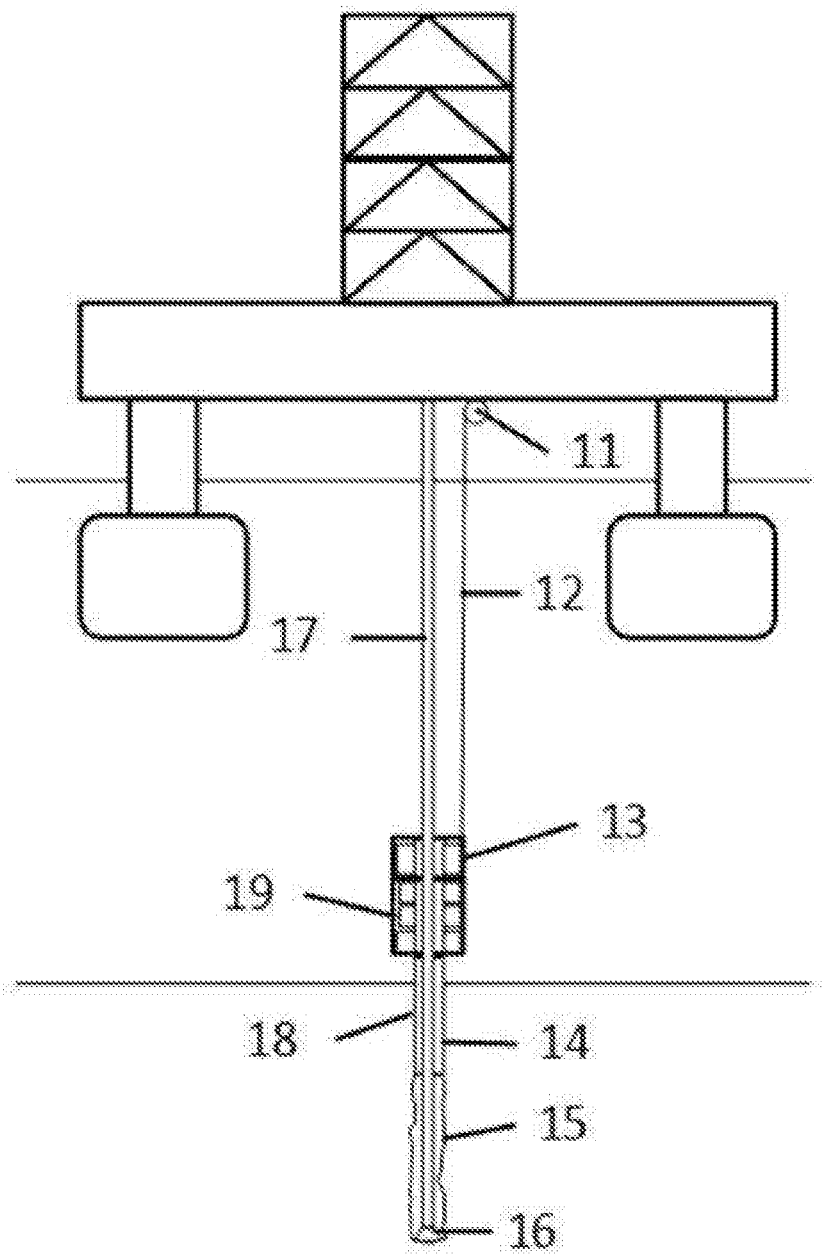
FIG. 1 illustrating the system while drilling a wellbore without the riser tubulars connected to the BOP and with reverse circulation of drilling fluid.

FIG. 1 shows the system during the drilling operation without riser tubulars and with fluid reverse circulation. In this system, the pumped drilling fluid passes through the reel (11) and the flexible line (12), being injected below the underwater rotating head with double seal (13). The fluid goes through the cased well annular (14) and through the open well annular (15). It then enters through the drill bit (16), taking with it the cut gravel during drilling, and returns through the drill string (17). In this situation, the casing valve (18) serves as a safety barrier for the withdrawal of the drill string (17). Finally, the BOP (19) is used as safety equipment for eventual emergencies and as a cleaning tool to enable the removal of the column without the leakage of fluids into the sea. The lowering of the BOP (19) can be done using a laying column or a cable.

Figure 2:
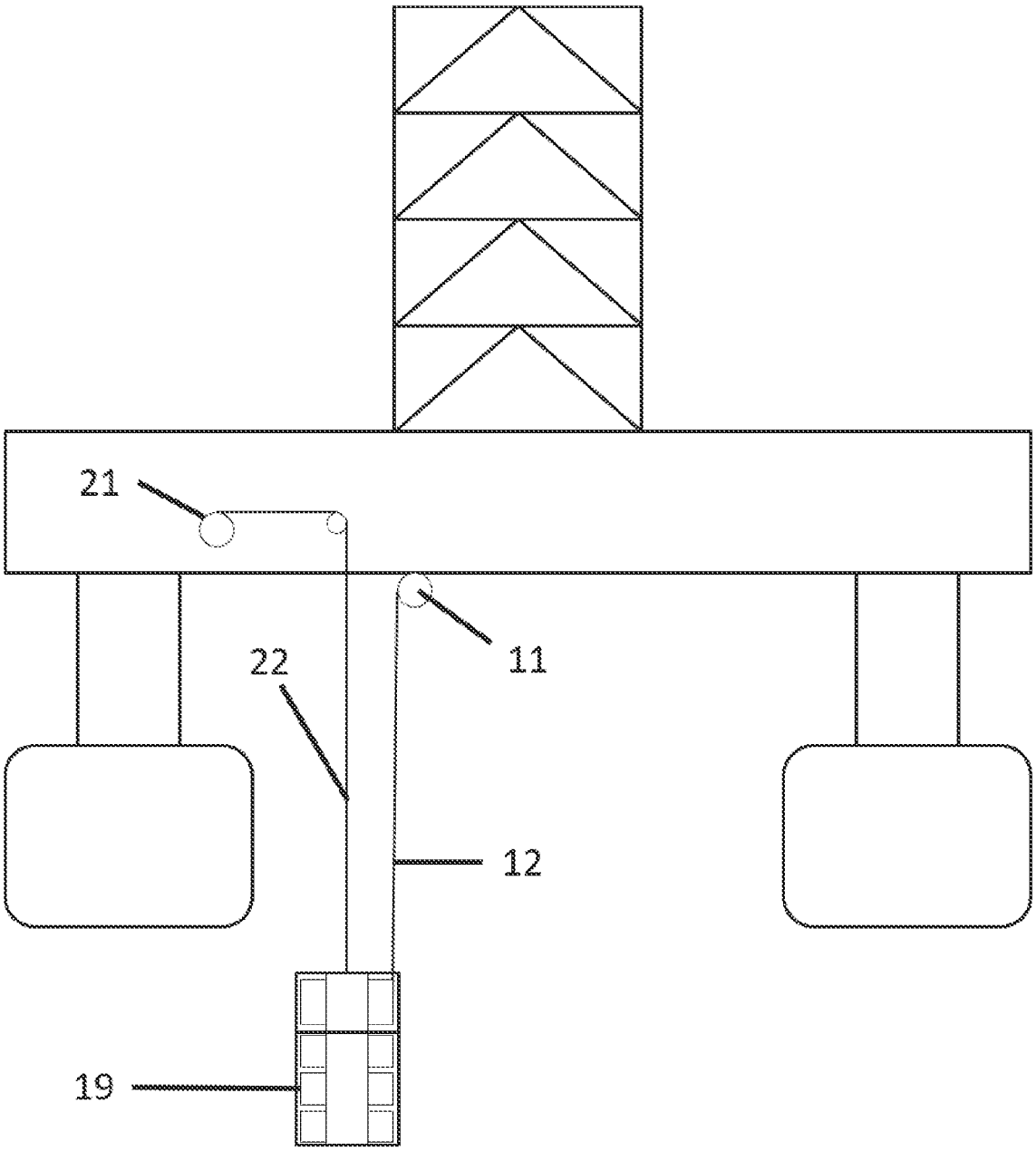
FIG. 2 illustrating the system during lowering of the BOP by cable.

FIG. 2 describes the system during the lowering of the BOP (19) with cable system (22) and the reel with the lowering cable (21). Optionally, the flexible lines (12) can be lowered from a similar reel (11) simultaneously with the lowering of the BOP (19).

Figure 3:
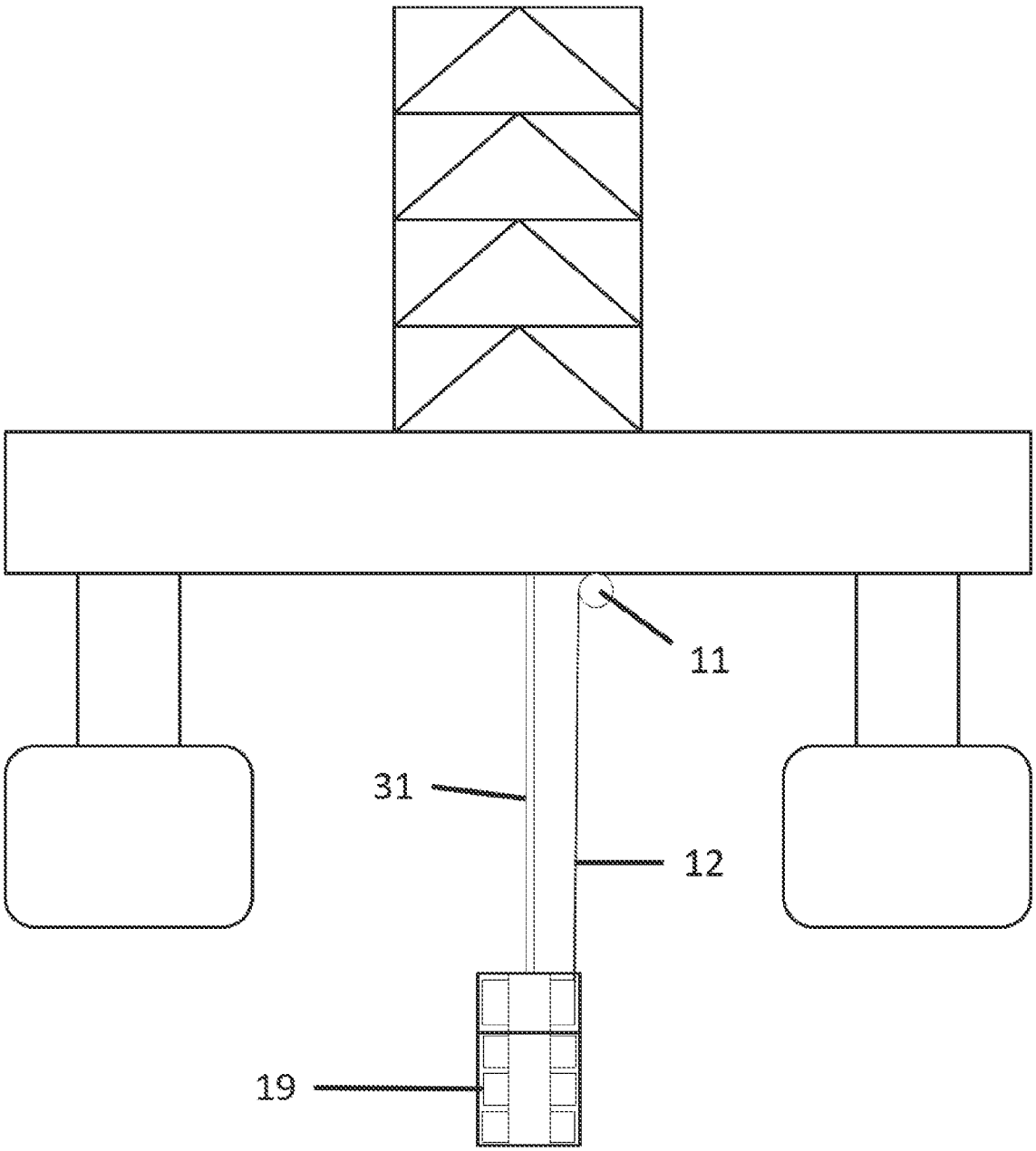
FIG. 3 illustrating the alternative system of lowering the BOP using a laying column.

FIG. 3 illustrates an alternative system of lowering the BOP (19) using a laying column (31). Optionally, flexible lines (12) can be lowered from a reel (11) simultaneously with the lowering of the BOP (19).

Figure 4:
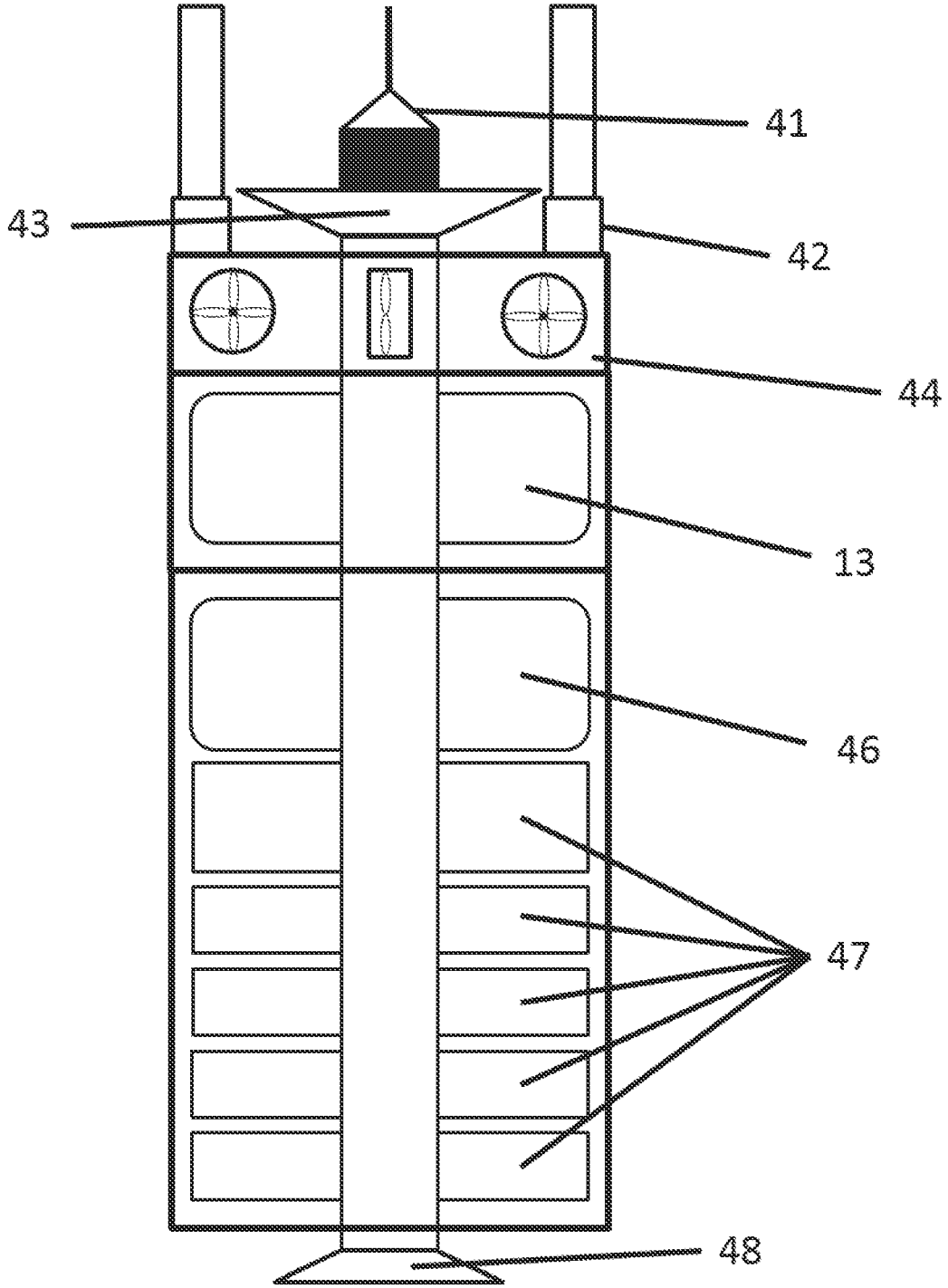
FIG. 4 illustrating the system for lowering and positioning the BOP over the wellhead when, optionally, lowered with a cable.

FIG. 4 describes the system for lowering and positioning the BOP when, optionally, lowered with a cable. FIG. 4 represents the entire BOP. Therein, the cable is connected to the BOP by a connector (41) and the injection lines are connected by another connector (42). There is a positioning system (44) to facilitate connection to the wellhead or the BAP (Production Adapter Base). This positioning system can optionally be driven by propellers or jets. There is also the underwater rotating head with double seal (13), the annular BOP (46), the drawers (47), and the upper (43) and lower (48) hoppers.

Figure 5:
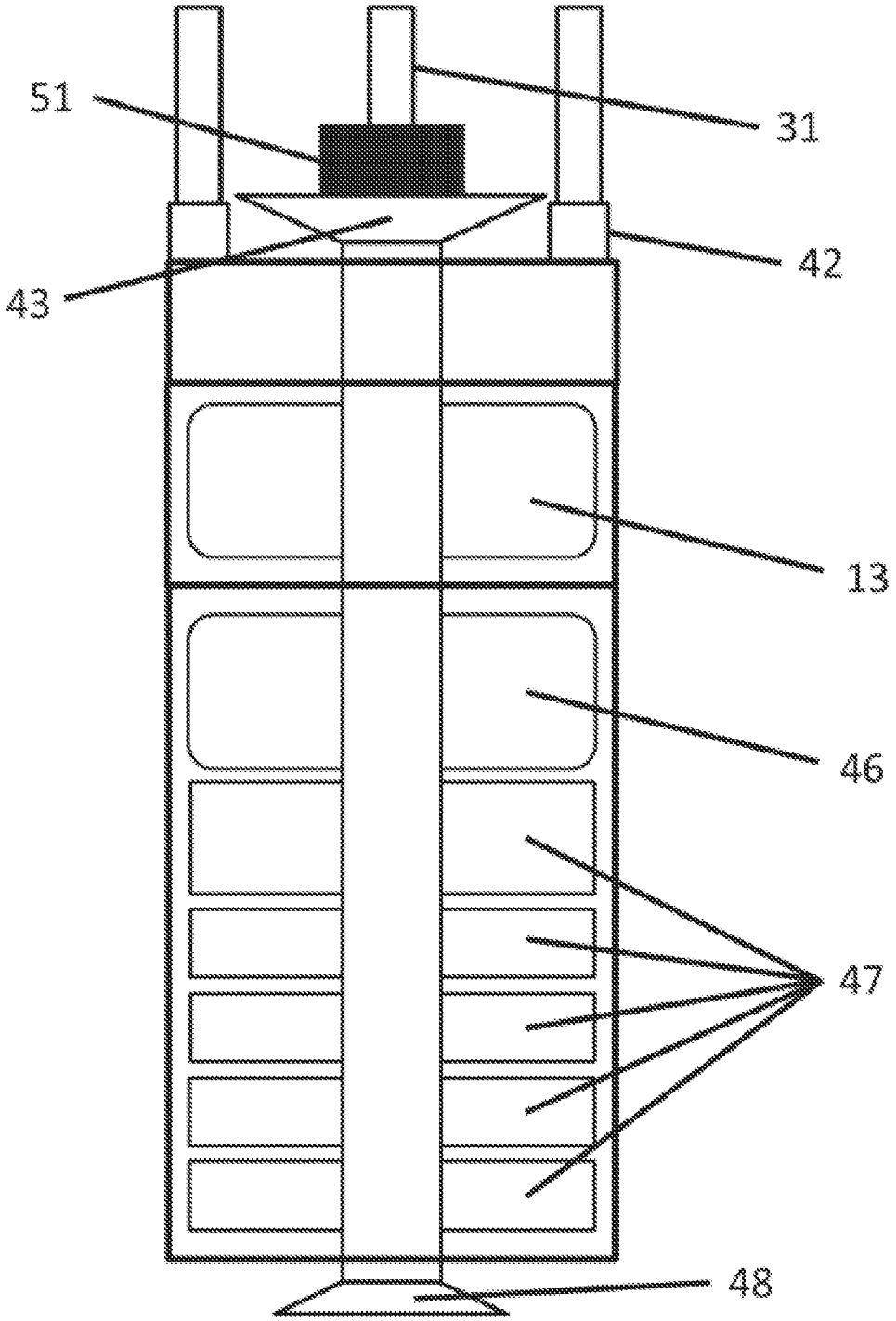
FIG. 5 illustrating the system for lowering and positioning the BOP over the wellhead when, optionally, lowered with the laying column.

FIG. 5 shows the lowering and positioning system of the BOP when, optionally, lowered with a laying column (31). FIG. 5 represents the entire BOP. Therein, the laying column (31) is connected to the BOP by a connector (51), and the injection lines are connected by another connector (42). There is also the underwater rotating head with double seal (13), the annular BOP (46), the drawers (47), and the upper (43) and lower (48) hoppers.

Numerous variations focusing on the protection scope of this application are allowed. Thus, it reinforces the fact that the present invention is not limited to the particular configurations and embodiments described above.

The invention claimed is:

1. A method of drilling a maritime wellbore with a maritime drilling system configured for fluid reverse circulation without using drilling riser tubulars, characterized by drilling operations without a riser and with reverse circulation, the method comprising:

lowering an injection flexible line (12) of the maritime drilling system from a reel (11) simultaneously with lowering a blow-out preventer (BOP) (19) of the maritime drilling system;

pumping drilling fluid through the injection flexible line (12), supported on the reel (11), of the maritime drilling system such that the drilling fluid is injected below an underwater rotating head with a double seal (13) of the maritime drilling system;

providing, after the drilling fluid is injected, the drilling fluid through a cased bore annular (14) and through an open wellbore annular (15) of the maritime drilling system;

providing, after the drilling fluid is provided through the cased bore annular (14) and the open wellbore annular (15), the drilling fluid through a drill bit (16) of the maritime drilling system, taking cut gravel with the drilling fluid during drilling; and returning, after the drilling fluid is provided through the drill bit (16), the drilling fluid through a drill string (17) of the maritime drilling system.

2. The method according to claim 1, wherein the BOP (19) of the maritime drilling system is lowered using a laying column (31) of the maritime drilling system.

3. The method according to claim 1, wherein the BOP (19) of the maritime drilling system is lowered using a cable (22) of the maritime drilling system.

4. The method according to claim 3, wherein the injection flexible line (12) is lowered from the reel (11) simultaneously with lowering the blow-out preventer (BOP) (19) of the maritime drilling system from another reel.

5. The method according to claim 4, further comprising connecting the injection flexible line (12) after lowering the injection flexible line (12).

6. The method according to claim 2, further comprising using jets of a positioning system (44) to facilitate connection of the BOP (19) with a wellhead or with a production adapter base (BAP).

7. The method of claim 2, further comprising using propellers of a positioning system (44) to facilitate connection of the BOP (19) with a wellhead or with a production adapter base (BAP).

8. The method according to claim 2, wherein the maritime drilling system further includes a casing valve (18) that is configured as a safety barrier for removal of the drill string (17).

9. The method according to claim 2, wherein the BOP (19) is configured to allow withdrawal of the drill string (17) without fluids leaking into the sea.

10. The method according to claim 2, further comprising connecting the laying column (31) to the BOP (19) by a connector (51), when installing the BOP (19).

* * * * *